United States Patent [19]

Jimenez

[11] Patent Number: 5,048,437

[45] Date of Patent: Sep. 17, 1991

[54] PRESSER DEVICE IN A SEWING MACHINE

[75] Inventor: Antonio Jimenez, Meyrin, Switzerland

[73] Assignee: Mefina S.A., Fribourg, Switzerland

[21] Appl. No.: 372,378

[22] PCT Filed: Nov. 16, 1988

[86] PCT No.: PCT/CH88/00212

§ 371 Date: May 11, 1989

§ 102(e) Date: May 11, 1989

[87] PCT Pub. No.: WO89/05880

PCT Pub. Date: Jun. 29, 1989

[30] Foreign Application Priority Data

Dec. 22, 1987 [CH] Switzerland ..... 4994/87

[51] Int. Cl.[5] ..... D05B 29/00; D05B 29/12

[52] U.S. Cl. ..... 112/235; 112/240

[58] Field of Search ..... 112/151, 153, 235, 240, 112/285

[56] References Cited

U.S. PATENT DOCUMENTS

| | | | |
|---|---|---|---|
| 765,884 | 7/1904 | Dormandy | 112/151 |
| 1,387,142 | 8/1921 | Flanagan . | |
| 2,241,778 | 5/1941 | Giancola | 112/151 |
| 2,545,980 | 3/1951 | Vanadia et al. . | |
| 3,143,094 | 8/1964 | Yamada | 112/235 |
| 3,203,384 | 8/1965 | Micale . | |
| 3,800,720 | 4/1974 | Niino | 112/235 |
| 4,165,699 | 8/1979 | Nishi | 112/240 |
| 4,359,955 | 11/1982 | Hida | 112/240 |
| 4,397,252 | 8/1983 | Fresard et al. . | |
| 4,416,208 | 11/1982 | Nufer | 112/240 |
| 4,492,173 | 1/1985 | Hirose | 112/240 |
| 4,548,145 | 10/1985 | Hirose | 112/240 |
| 4,733,622 | 3/1988 | Larsen et al. | 112/240 |

FOREIGN PATENT DOCUMENTS

| | | | |
|---|---|---|---|
| 0047225 | 3/1982 | European Pat. Off. . | |
| 1240290 | 7/1960 | France . | |
| 0194788 | 11/1984 | Japan | 112/235 |
| 2079093 | 4/1987 | Japan | 112/235 |
| 0633335 | 11/1982 | Switzerland | 112/285 |
| 2071713 | 9/1981 | United Kingdom | 112/285 |

*Primary Examiner*—Werner H. Schroeder
*Assistant Examiner*—Sullivan C. Prak
*Attorney, Agent, or Firm*—Young & Thompson

[57] ABSTRACT

Presser device in a sewing machine, comprising a support provided with structure for holding and releasing a presser foot. The support is of a general parallelepiped shape and has two parallel grooves that are arranged on two opposing lateral faces of the support, these grooves forming sliding guides for a sewing attachment. One face of the support comprises a translucent window, an electrical bulb being arranged in the support behind the window. The support also has at least one bore for receiving a rod for securing a sewing attachment. This bore is perpendicular to the axis of the presser bar. The support also has two parallel grooves arranged on its other two lateral faces.

9 Claims, 1 Drawing Sheet

PRESSER DEVICE IN A SEWING MACHINE

BACKGROUND OF THE INVENTION

In sewing machines, it is known to provide a presser device comprising a support equipped with means for holding and releasing a presser foot.

It is also known to provide various sewing attachments that can be used with a sewing machine and that are often secured to the presser bar.

BRIEF SUMMARY OF THE INVENTION

The aim of the invention is to facilitate the fitting and removal of these attachments. This aim is achieved owing to the fact that the support of the presser bar has at least one groove forming a sliding guide for a sewing attachment.

BRIEF DESCRIPTION OF THE DRAWING

The attached drawing shows diagrammatically and by way of example an embodiment of the subject of the invention.

DETAILED DESCRIPTION OF THE INVENTION

Figure 1:
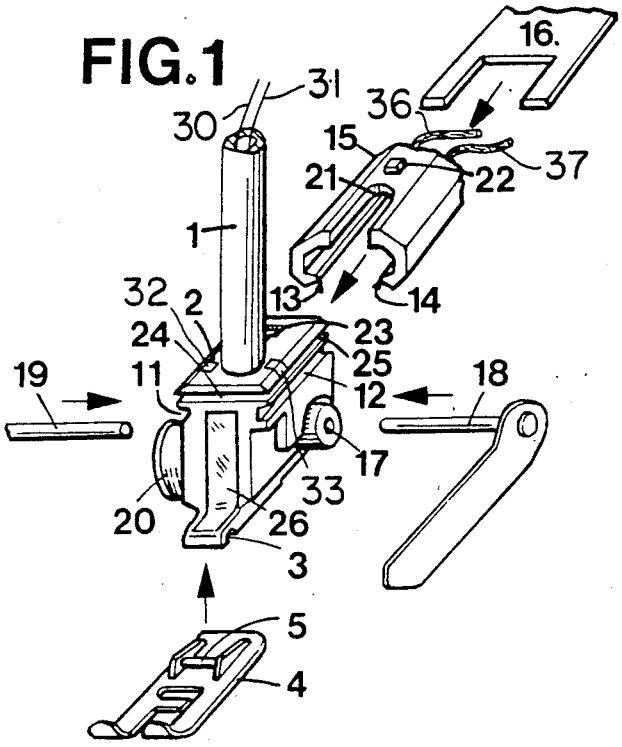
FIG. 1 is an exploded perspective view of the lower portion of a presser bar and shows various sewing attachments that can be secured to that bar.
Figure 2:
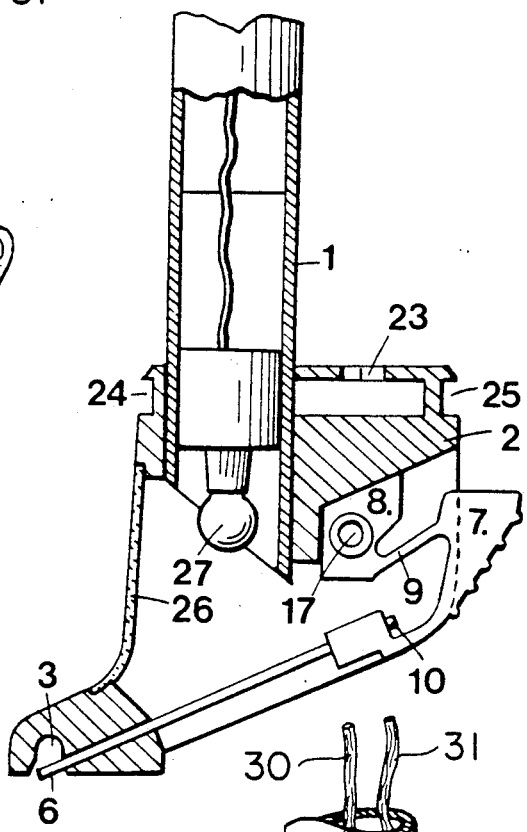
FIG. 2 is a section through the support which is fixedly joined to the lower end of the presser bar, taken in a plane which is parallel to the direction of movement of the material.
Figure 3:
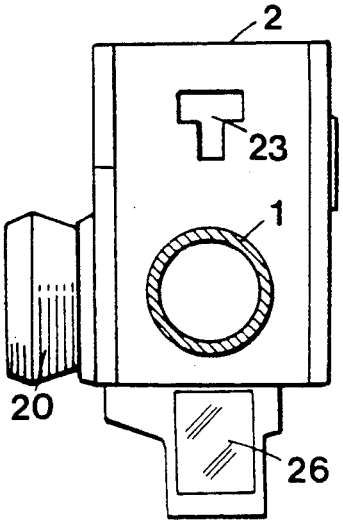
FIG. 3 is a view of the upper face of the support.
Figure 4:
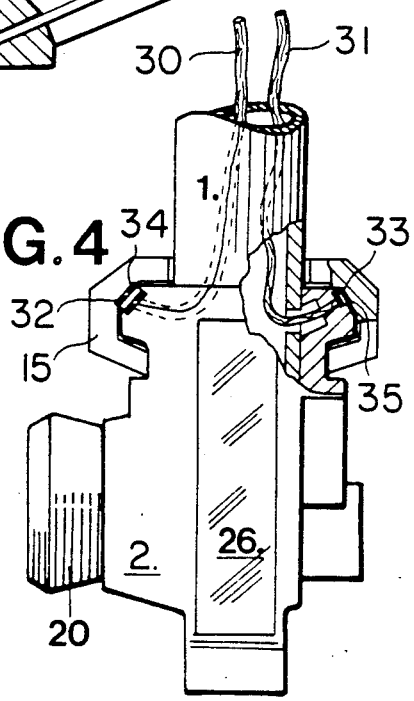
FIG. 4 is a front view of the support.

FIG. 1 is an exploded perspective view of a portion of a presser bar 1 the lower end of which is provided with a support 2. The support has a recess 3 permitting the attachment of a presser foot 4 that is provided with a small transverse bar 5. As shown in FIG. 2, the presser foot is held in the recess 3 by means of a sliding plate 6 that can be retracted to release the foot by acting on a control lever 7 having a securing plate 8 to which it is connected by a flexible plate 9. The plate 6 has a head 10 connected to a portion of the lever 7. Pressure exerted on thet lever 7 causes the plate 6 to be withdrawn in order to free the recess 3 by bending of the plate 9. As shown in FIGS. 1 and 4, the support 2 has two parallel grooves 11 and 12 that are arranged on two opposing lateral faces of the support. Those grooves make it possible to secure to the support various sewing attachments having a portion provided with tongues 13 and 14 that engage in said grooves. Two examples of the form these portions take are indicated at 15 and 16 in FIG. 1.

The support 2 also has a bore 17 permitting the fitting of attachments provided with a rod, such as 18 or 19, that engages in bore 17, which is perpendicular to the axis of the bar 1.

The support 2 is provided with a thread-cutting device 20, for example of the type described in a U.S. Pat. No. 4,397,252.

In the case of the portion 15, which has a recess 21 that engages on the base of the bar 1, there is provided a Locking lug 22 that engages in an opening 23 provided on the upper base of the support 2 in order to form a detent for keeping in place the attachment combined with the portion 15.

The support also has two grooves 24 and 25 on its front and rear faces so that it is possible to secure different sewing attachments to the support 2 at the same time, for example a special foot, especially a darning foot, and a transparent protective screen for preventing the user from introducing his or her fingers into the operating zone of the needle.

The front face of the support 2 is provided with a translucent window 26 behind which is arranged an electrical bulb 27 (FIG. 2) mounted in the lower portion of the bar 1, which facilitates the operation of introducing the thread into the eye of the needle by providing suitable illamination.

In order to achieve automatic control of the operating mode of the machine, it is possible to provide one or more electrical contacts 32,33 on the support 2, these contacts being actuated by the positioning of a specific attachment on the support. Those contacts could be placed in one or more of the grooves 11, 12, 24, and 25, or inside the bore 17 or below the opening 23. It is clear that those contacts should be connected to at least one insulated conductor 30, 31, passing into the bar 1, the latter having a separate conductive portion co-operating with a contact socket forming part of the the sewing machine. Thus, when using a sewing attachment that requires a speed that is lower or higher than the normal range of speeds, the closing of at least one corresponding contact 34, 35 connected to the sewing machine motor by at least one insulated conductor 36, 37 could be used to bring about the appropriate change in speed. The contact(s) could also be arranged to supply at least one motor or a device forming part of an attachment. By way of example, it is possible to provide an electrical motor for actuating a material-cutting attachment, or even two motors for bringing about specific movements of a piece of embroidery.

The support described makes it possible to secure to the presser bar sewing attachments such as a darning foot, a gathering foot, a looping foot, a universal material guide, a monogram guide, or the like.

It is obvious that it would be possible to provide various modifications or simplifications. In particular, the support 2 could have only a single groove, which could be in the form of, for example, a dovetail, and could be provided with a tightening screw to lock in position the part introduced into that groove.

I claim:

1. Presser device in a sewing machine, comprising a support provided with means for holding and releasing a presser foot, the support being of a general parallelepiped shape and having two parallel grooves that are arranged on two opposing lateral faces of the support, said grooves forming sliding guides for a sewing attachment.

2. Device according to claim 1 wherein one face of the support comprises a translucent window, an electrical bulb being arranged in the support behind said window.

3. Device according to claim 1, wherein the support also has at least one bore for receiving a rod for securing a sewing attachment.

4. Device according to claim 3, wherein the bore of the support is perpendicular to the axis of the presser bar.

5. Device according to claim 1, wherein the support is provided with a thread-cutting device.

6. Device according to claim 1, wherein the support also has two parallel grooves arranged on its other two lateral faces.

7. Device according to claim 1, wherein two parallel grooves define a plane perpendicular to the axis of the presser bar.

8. Device according to claim 1, wherein the support has at least one detent for holding the sewing attachment on the support.

9. Device according to claim 1, wherein the support is provided with at least one electrical contact arranged in such a manner that it is actuated by the attachment placed on the support.

* * * * *